US008303252B2

(12) United States Patent
Piggush

(10) Patent No.: US 8,303,252 B2
(45) Date of Patent: Nov. 6, 2012

(54) AIRFOIL WITH COOLING PASSAGE PROVIDING VARIABLE HEAT TRANSFER RATE

(75) Inventor: Justin D. Piggush, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 947 days.

(21) Appl. No.: 12/252,514

(22) Filed: Oct. 16, 2008

(65) Prior Publication Data

US 2010/0098526 A1 Apr. 22, 2010

(51) Int. Cl.
*F01D 5/18* (2006.01)
*F01D 5/00* (2006.01)

(52) U.S. Cl. ..... 416/97 R; 416/96 R; 416/96 A; 415/115

(58) Field of Classification Search ..... 416/96 R, 416/96 A, 97 R; 415/115
See application file for complete search history.

(56) References Cited

U.S. PATENT DOCUMENTS

| | | | | |
|---|---|---|---|---|
| 3,978,731 | A | 9/1976 | Reeder et al. | |
| 4,738,587 | A * | 4/1988 | Kildea | 416/96 R |
| 5,002,460 | A * | 3/1991 | Lee et al. | 416/96 A |
| 5,156,526 | A * | 10/1992 | Lee et al. | 416/97 R |
| 5,165,852 | A * | 11/1992 | Lee et al. | 416/97 R |
| 5,484,258 | A * | 1/1996 | Isburgh et al. | 415/115 |
| 5,720,431 | A * | 2/1998 | Sellers et al. | 416/97 R |
| 5,735,335 | A | 4/1998 | Gilmore et al. | |
| 5,820,337 | A | 10/1998 | Jackson et al. | |
| 5,931,638 | A * | 8/1999 | Krause et al. | 416/97 R |
| 6,000,906 | A | 12/1999 | Draskovich | |
| 6,139,258 | A | 10/2000 | Lang, III et al. | |
| 6,164,912 | A | 12/2000 | Tabbita et al. | |
| 6,234,755 | B1 | 5/2001 | Bunker et al. | |
| 6,247,896 | B1 | 6/2001 | Auxier et al. | |
| 6,264,428 | B1 * | 7/2001 | Dailey et al. | 416/97 R |
| 6,280,140 | B1 | 8/2001 | Soechting et al. | |
| 6,331,098 | B1 * | 12/2001 | Lee | 416/97 R |
| 6,607,355 | B2 | 8/2003 | Cunha et al. | |
| 6,705,831 | B2 | 3/2004 | Draper | |
| 6,743,350 | B2 * | 6/2004 | Lee et al. | 205/686 |
| 6,890,154 | B2 | 5/2005 | Cunha | |
| 6,896,487 | B2 | 5/2005 | Cunha et al. | |
| 6,913,064 | B2 | 7/2005 | Beals et al. | |
| 6,929,054 | B2 | 8/2005 | Beals et al. | |
| 6,932,145 | B2 | 8/2005 | Frasier et al. | |

(Continued)

FOREIGN PATENT DOCUMENTS

EP 0 924 382 12/1998

*Primary Examiner* — Barbara Summons
(74) *Attorney, Agent, or Firm* — Carlson, Gaskey & Olds, PC

(57) ABSTRACT

A turbine engine airfoil includes an airfoil structure having a side with an exterior surface. The structure includes a cooling passage extending a length within the structure and providing a convection surface facing the side. The convection surface is twisted along the length, which varies a heat transfer rate between the exterior surface and the convection surface along the length. In one example, the cooling passage is provided by a refractory metal core that is used during the airfoil casting process. The core includes multiple legs joined by a connecting portion. At least one of the legs is twisted along its length. The legs are deformed toward one another opposite the connecting portion to provide a desired core shape that corresponds to the shape of the cooling passage. Accordingly, the cooling passage provides desired cooling of the airfoil.

13 Claims, 4 Drawing Sheets

U.S. PATENT DOCUMENTS 6,932,571 B2 8/2005 Cunha et al.
6,955,522 B2 10/2005 Cunha et al.
6,994,521 B2 2/2006 Liang
7,014,424 B2 3/2006 Cunha et al.
7,097,424 B2 8/2006 Cunha et al.
7,097,425 B2 8/2006 Cunha et al.
7,108,045 B2 9/2006 Wiedemer et al.
7,131,818 B2 11/2006 Cunha et al.
7,137,776 B2 11/2006 Draper et al.
7,172,012 B1 2/2007 Memmen
7,174,945 B2 2/2007 Beals et al.
7,185,695 B1 3/2007 Santeler
7,216,689 B2 5/2007 Verner et al.
7,217,094 B2 5/2007 Cunha et al.
7,217,095 B2 5/2007 Pietraszkiewicz et al.
7,220,103 B2 5/2007 Cunha et al.
7,255,536 B2 8/2007 Cunha et al.
7,258,156 B2 8/2007 Santeler
7,270,170 B2 9/2007 Beals et al.
7,302,990 B2 12/2007 Bunker et al.
7,303,375 B2 12/2007 Cunha et al.
7,306,024 B2 12/2007 Beals et al.
7,306,026 B2 12/2007 Memmen
7,311,497 B2 12/2007 Sharma et al.
7,311,498 B2 12/2007 Cunha et al.
7,322,795 B2 1/2008 Luczak et al.
7,343,960 B1 3/2008 Frasier et al.
7,364,405 B2 4/2008 Cunha et al.
7,488,156 B2 * 2/2009 Liang ..... 416/97 R
7,563,072 B1 * 7/2009 Liang ..... 416/96 A
2005/0156361 A1 7/2005 Holowczak et al.
2006/0083613 A1 4/2006 Cunha et al.
2006/0083614 A1 4/2006 Cunha et al.
2006/0093480 A1 5/2006 Cunha et al.
2006/0107668 A1 5/2006 Cunha et al.
2006/0239819 A1 10/2006 Albert et al.
2006/0263221 A1 11/2006 Cunha et al.
2007/0048122 A1 3/2007 Van Suetendael, IV et al.
2007/0048128 A1 3/2007 Cunha et al.
2007/0048134 A1 3/2007 Cunha et al.
2007/0104576 A1 5/2007 Cunha et al.
2007/0116566 A1 5/2007 Cunha et al.
2007/0116568 A1 5/2007 Cunha et al.
2007/0116569 A1 5/2007 Cunha et al.
2007/0147997 A1 6/2007 Cunha et al.
2007/0172355 A1 7/2007 Cunha et al.
2007/0177976 A1 8/2007 Cunha et al.
2007/0189897 A1 * 8/2007 Pietraszkiewicz et al. . 416/97 R
2007/0224048 A1 9/2007 Abdel-Messeh et al.
2007/0227706 A1 10/2007 Lutjen et al.
2007/0237638 A1 10/2007 Sharma et al.
2007/0248462 A1 10/2007 Lutjen et al.
2007/0286735 A1 12/2007 Cunha et al.
2008/0008599 A1 1/2008 Cunha et al.
2008/0019839 A1 1/2008 Cunha et al.
2008/0019840 A1 1/2008 Cunha
2008/0019841 A1 1/2008 Cunha
2008/0056909 A1 3/2008 Cunha et al.

* cited by examiner

AIRFOIL WITH COOLING PASSAGE PROVIDING VARIABLE HEAT TRANSFER RATE

BACKGROUND

This disclosure relates to a cooling passage for an airfoil.

Turbine blades are utilized in gas turbine engines. As known, a turbine blade typically includes a platform having a root on one side and an airfoil extending from the platform opposite the root. The root is secured to a turbine rotor. Cooling circuits are formed within the airfoil to circulate cooling fluid, such as air. Typically, multiple relatively large cooling channels extend radially from the root toward a tip of the airfoil. Air flows through the channels and cools the airfoil, which is relatively hot during operation of the gas turbine engine.

Some advanced cooling designs use one or more radial cooling passages that extend from the root toward the tip. Typically, the cooling passages are arranged between the cooling channels and an exterior surface of the airfoil. The cooling passages provide extremely high convective cooling.

The Assignee of the present disclosure has discovered that in some cooling designs the airfoil is overcooled at the base of the airfoil near the platform. It is believed that strong secondary flows, particularly on the suction side, force the migration of relatively cool fluid off the end wall and onto the suction side of the blade. This results in relatively low external gas temperatures. Internally, the coolant temperature is relatively cool as it has just entered the blade. The high heat transfer coefficients provided by the cooling passage in this region are undesirable as it causes overcooling of the external surface and premature heating of the coolant air.

What is needed is a cooling passage that provides desired cooling of the airfoil.

SUMMARY

A turbine engine airfoil is disclosed that includes an airfoil structure having a side with an exterior surface. The structure includes a cooling passage extending a length within the structure and providing a convection surface facing the side. The convection surface is twisted along the length, which varies a heat transfer rate between the exterior surface and the convection surface along the length.

In one example, the cooling passage is provided by a refractory metal core that is used during the airfoil casting process. The core includes multiple legs arranged in a fan-like shape and joined by a connecting portion. At least one of the legs is twisted along its length. The legs are deformed toward one another opposite the connecting portion to provide a desired core shape that corresponds to the shape of the cooling passage.

Accordingly, the cooling passage provides desired cooling of the airfoil by varying the cooling rate as desired.

These and other features of the disclosure can be best understood from the following specification and drawings, the following of which is a brief description.

DETAILED DESCRIPTION

Figure 1:
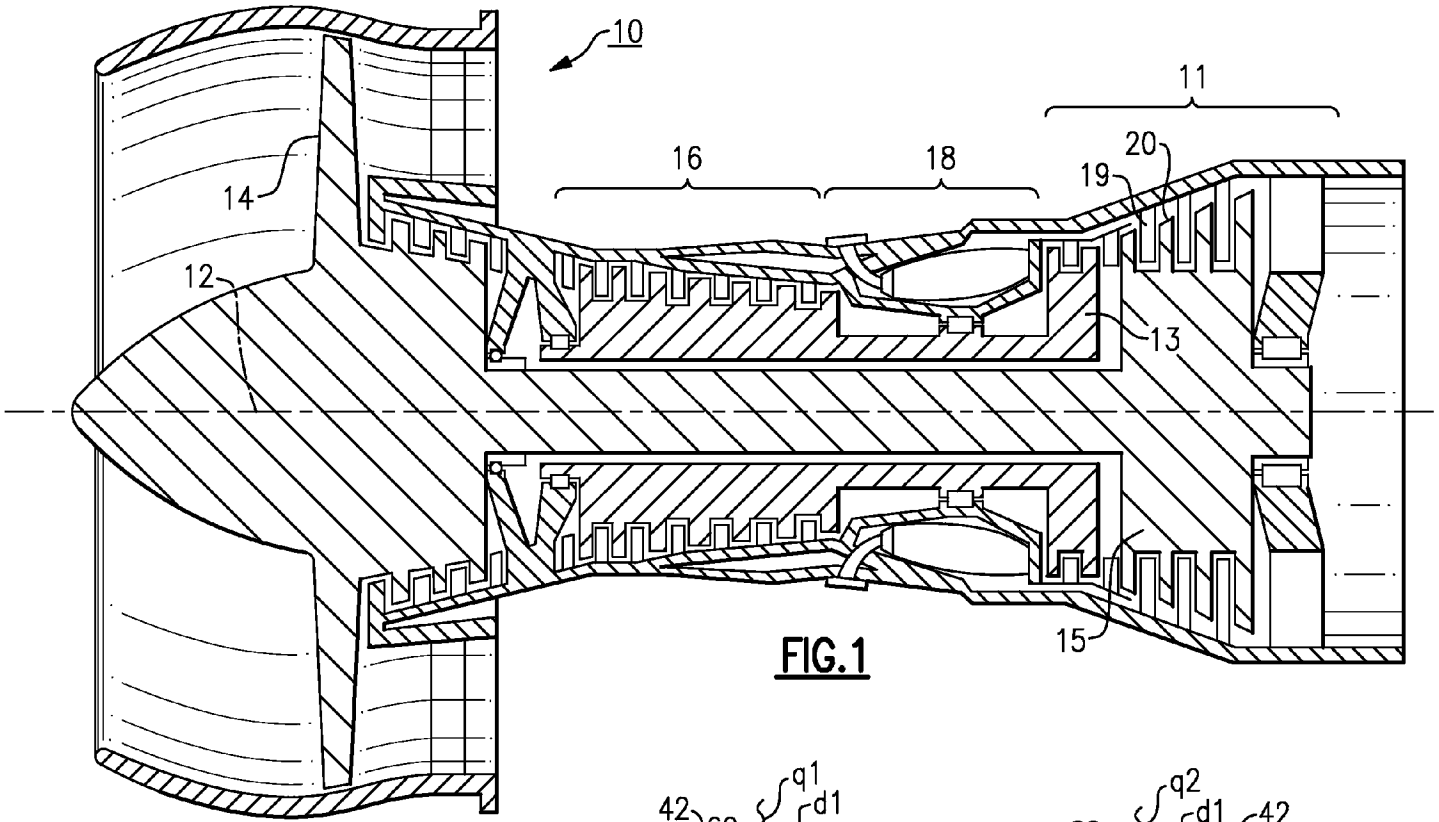
FIG. 1 is a schematic view of a gas turbine engine incorporating the disclosed airfoil.

FIG. 1 schematically illustrates a gas turbine engine 10 that includes a fan 14, a compressor section 16, a combustion section 18 and a turbine section 11, which are disposed about a central axis 12. As known in the art, air compressed in the compressor section 16 is mixed with fuel that is burned in combustion section 18 and expanded in the turbine section 11. The turbine section 11 includes, for example, rotors 13 and 15 that, in response to expansion of the burned fuel, rotate, which drives the compressor section 16 and fan 14.

The turbine section 11 includes alternating rows of blades 20 and static airfoils or vanes 19. It should be understood that FIG. 1 is for illustrative purposes only and is in no way intended as a limitation on this disclosure or its application.

Figure 2:
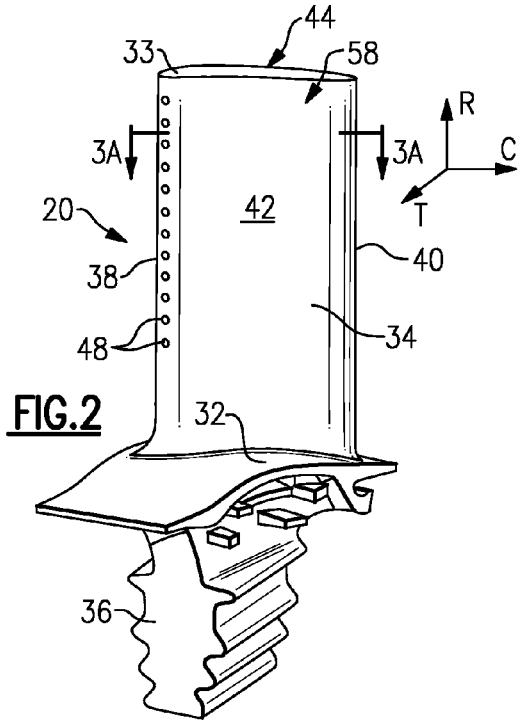
FIG. 2 is a perspective view of the airfoil having the disclosed cooling passage.

An example blade 20 is shown in FIG. 2. The blade 20 includes a platform 32 supported by a root 36, which is secured to a rotor. An airfoil 34 extends radially outwardly from the platform 32 opposite the root 36. While the airfoil 34 is disclosed as being part of a turbine blade 20, it should be understood that the disclosed airfoil can also be used as a vane.

The airfoil 34 includes an exterior surface 58 extending in a chord-wise direction C from a leading edge 38 to a trailing edge 40. The airfoil 34 extends between pressure and suction sides 42, 44 in an airfoil thickness direction T, which is generally perpendicular to the chord-wise direction C. The airfoil 34 extends from the platform 32 in a radial direction R to an end portion or tip 33. Cooling holes 48 are typically provided on the leading edge 38 and various other locations on the airfoil 34 (not shown).

Figure 3B:
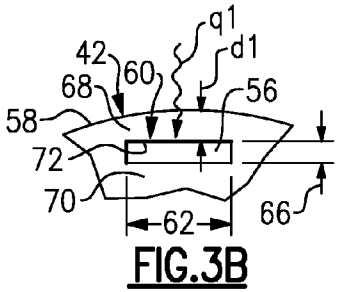
FIG. 3B is a top elevational view of the airfoil portion shown in FIG. 3A.
Figure 3C:
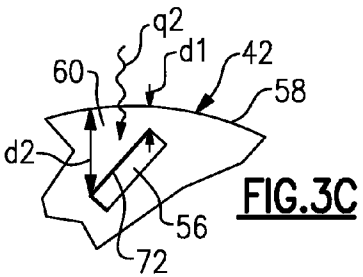
FIG. 3C is a bottom elevational view of the airfoil portion shown in FIG. 3A.
Figure 3A:
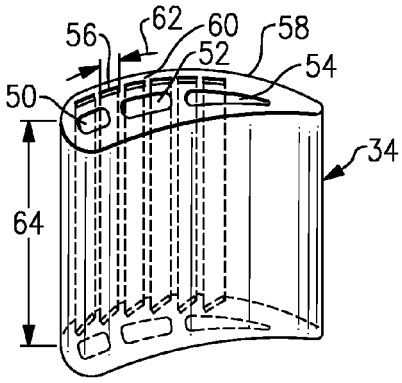
FIG. 3A is a cross-sectional view of a portion of the airfoil shown in FIG. 2 and taken along 3A-3A.

Referring to FIG. 3A, multiple, relatively large radial cooling channels 50, 52, 54 are provided internally within the airfoil 34 to deliver airflow for cooling to the airfoil. The cooling channels 50, 52, 54 provide cooling air, typically from the root 36 of the blade 20.

Figure 5:
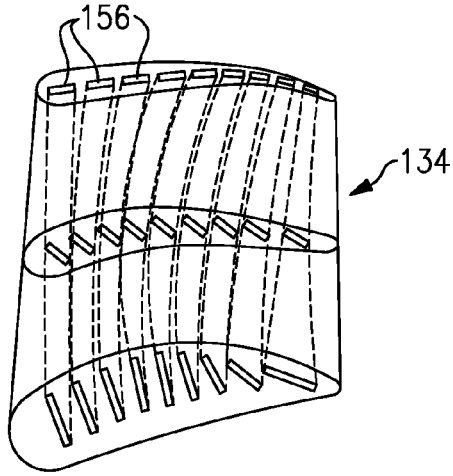
FIG. 5 is a perspective view of another example airfoil having another cooling passage arrangement.

Current advanced cooling designs incorporate supplemental cooling passages arranged between the exterior surface 58 and one or more of the cooling channels 50, 52, 54. The larger cooling channels can be omitted entirely, if desired, as shown in FIG. 5. In one disclosed example, one or more radially extending cooling passages 56 are provided in a wall 60 between the exterior surface 58 and the cooling channels 50, 52, 54 at the suction side 44. First and second wall portions 68, 70 are provided on either side of each radial cooling passage 56 respectively adjacent to the exterior surface 58 and the cooling channel 52, for example. However, it should be understood that the example cooling passages could also be provided at other locations within the airfoil.

As shown in FIG. 3A, the cooling passage 56 extends along a length 64 from the platform 32 toward the tip 33. Each cooling passage 56 includes a width 62 and a thickness 66. The width 62 is substantially greater than the thickness 66. The length 64 is substantially greater than the width 62 and the thickness 66.

Referring to FIGS. 3B and 3C, the cooling passage 56 includes a convection surface 72 having an orientation relative to the exterior surface 58 that changes along the length 64. In one example, the convection surface 72 is generally uniform in width along the length 64. The cooling passage 56 has a generally uniform rectangular cross-sectional shape in the example shown. In some applications it is desirable that the airfoil 34 have a lower heat transfer rate near the platform 32 than the tip 33.

Referring to FIG. 3B, the convection surface 72 is arranged at a distance d1 from the exterior surface 58. In the example, the exterior surface 58 and convection surface 72 are generally parallel to one another. The cross-sectional areas illustrated in FIGS. 3B and 3C are generally perpendicular to the radial direction R. The convection surface 72 has a heat transfer rate q1 at the illustrated location. The convection surface 72 is twisted along the length 64, which changes the spacing of the convection surface 72 relative to the exterior surface 58, as shown in FIG. 3C. For example, referring to FIG. 3C, one portion of the convection surface 72 is arranged the distance d1 from the exterior surface 58 while another portion of the convection surface 72 is arranged at a distance d2 from the exterior surface 58. The second distance d2 is greater than the distance d1, which results in a reduced heat transfer rate q2 relative to the heat transfer rate q1. The reduced heat transfer rate q2 results, in part, from the increased volume of the wall 60 between the cooling passage 56 and the exterior surface 58 as compared to the location illustrated in FIG. 3B.

Figure 4A:
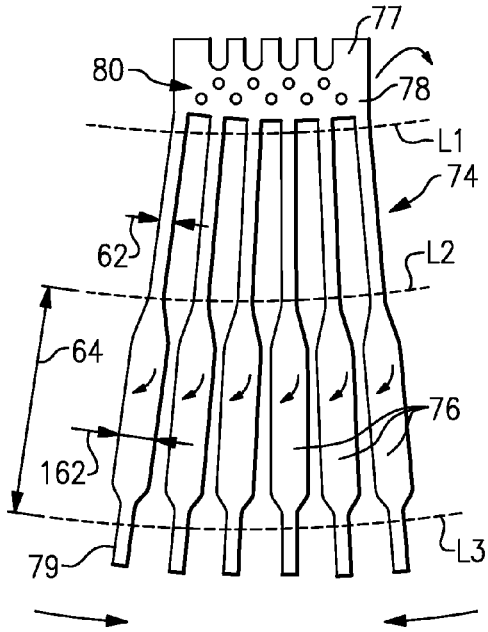
FIG. 4A is an elevational view of one example core structure prior to shaping the core to a desired core shape.

An example core structure 74 for forming the disclosed cooling passages 56 is shown in FIG. 4A. The core structure 74 includes multiple legs 76 that are joined relative to one another by a connecting portion 78. The connecting portion 78 may also be positioned outside the cast part and removed along with the rest of the core structure upon final part finishing. A portion of each leg 76 includes a taper provided by a width 162 that is greater than the width 62, which is in closer proximity to the tip 33.

The reduction in the cross-sectional area increases the Mach number as the coolant moves to the end of the cooling passage 56. The increase in Mach number in turn allows the heat transfer coefficient, h, near the exit of the cooling passage to be higher than near its inlet. This allows the designer to maintain a uniform value (or adjust to the most desirable value) based upon the product of $h*A*(\Delta T)$ resulting in a uniformly cooled blade, where h is the convection heat transfer coefficient, A is the area and $\Delta T$ is the temperature gradient. The twisting and overlapping cooling passages reduce the heat transfer coefficient and thereby reduce the heat transfer rate q going into the coolant fluid. The reduced q indicates less overcooling in regions where the twist and overlap is used.

Figure 4B:
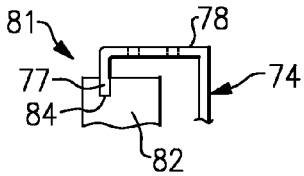
FIG. 4B is a partial cross-sectional view of a portion of the core structure cooperating with a second core structure, which provides a cooling channel.

With continuing reference to FIG. 4A, the core structure 74 is manipulated to a desired shape by folding a top portion 80 over line L1. The top portion 80 is arranged in close proximity to the tip 33 during the casting process. Portions 77 on the top portion 80 cooperate with a second core 82 to provide a core assembly 81, as shown in FIG. 4B. In one example, the core structure 74 is provided by a refractory metal material, and the second core 82 is provided by a ceramic material. The second core 82 includes a recess 84 that receives the portion 77. In this manner, the cooling passages 56 and cooling channels, 50, 52, 54 are in fluid communication with one another in the finished airfoil.

Figure 4D:
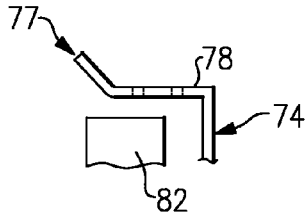
FIG. 4D is another embodiment illustrating a portion of the core structure cooperating with the second core structure.
Figure 4C:
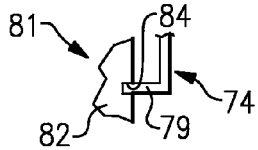
FIG. 4C is a partial cross-sectional view of another portion of the core structure cooperating with the second core structure.

Returning to FIG. 4A, the portion of the legs 76 having the width 62 remain generally coplanar with one another while the portions of the legs 76 between the lines L2 and L3 are twisted relative to the narrower leg portions arranged between lines L1 and L2. The legs 76 include portions 79 that cooperate with the recess 84 in second core 82, as shown in FIG. 4C. Referring to FIG. 4D, the portion 77 can extend toward the tip of the airfoil and away from the second core 82 to a location outside of the airfoil. As a result, cooling passages will be provided at the tip by the portion 77 once the core structure 74 has been removed from the airfoil.

Figure 6A:
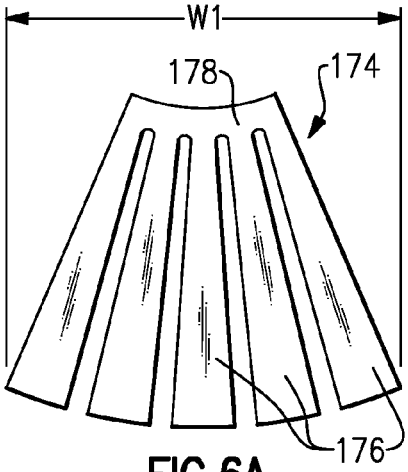
FIG. 6A is a top elevational view of another example core structure used in forming the cooling passage arrangement shown in FIG. 5.
Figure 6B:
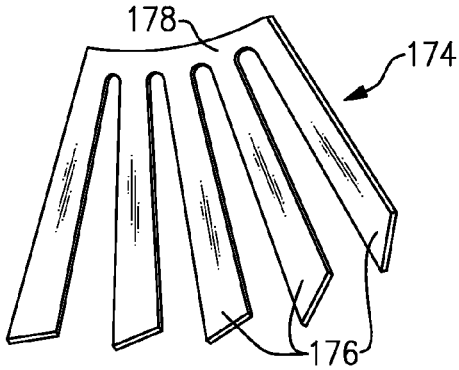
FIG. 6B is a top elevational view of the core structure shown in FIG. 6A subsequent to twisting legs of the structure.
Figure 6C:
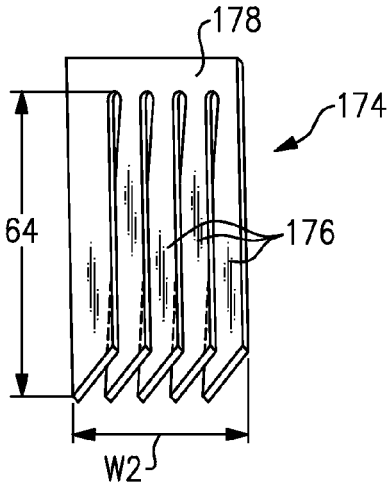
FIG. 6C is a top elevational view of the core structure shown in FIG. 6B subsequent to deforming the legs toward one another.

Another airfoil 134 shown in FIG. 5 includes cooling passages 156. In the example shown, the airfoil 134 does not include the larger cooling channels that are typically formed by ceramic cores. A core structure 174 that provides the cooling passages 156 is shown in FIGS. 6A-6C. The core structure 174 is stamped from a refractory metal material in a fan-like arrangement to provide multiple tapered legs 176 that are joined with a connecting portion 178. The legs 176 have an initial width W1. The legs 176 are twisted from their initial position relative to the connecting portion 178, as shown in FIG. 6B. After the legs 176 have been twisted, the legs 176 are deformed and pushed toward one another at a location opposite the connecting portion 178 to a width W2 to provide the desired core shape, which is shown in FIG. 6C.

Figure 8A:
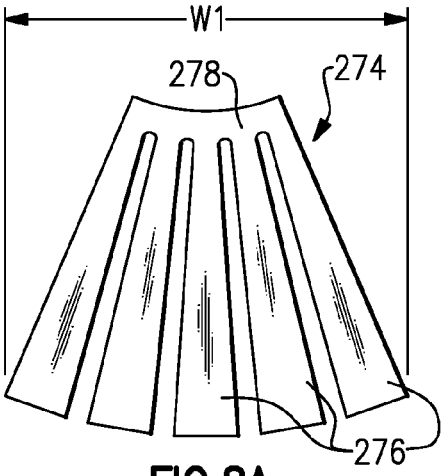
FIG. 8A is a top elevational view of another example core structure used in forming the cooling passage arrangement shown in FIG. 7.
Figure 8B:
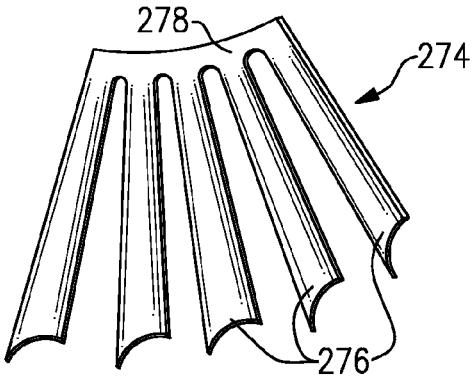
FIG. 8B is a top elevational view of the core structure shown in FIG. 8A subsequent to twisting and cupping legs of the structure.
Figure 7:
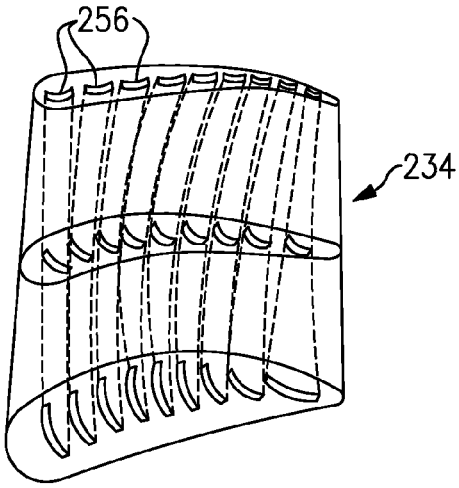
FIG. 7 is a perspective view of another example airfoil having another cooling passage arrangement.
Figure 8C:
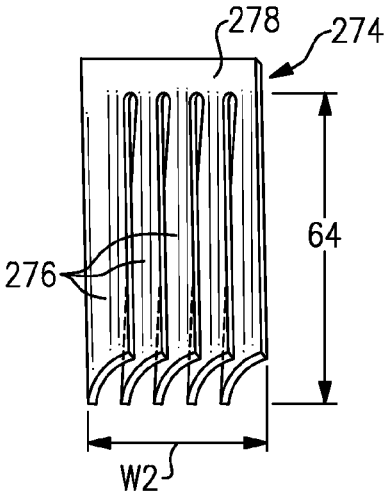
FIG. 8C is a top elevational view of the core structure shown in FIG. 8B subsequent to deforming the legs toward one another.

Another airfoil 234 having cooling passages 256 similar to those shown in FIG. 5 is shown in FIG. 7. In the example shown, the airfoil 234 does not include the larger cooling channels that are typically formed by ceramic cores. A core structure 274 that provides the cooling passages 256 is shown in FIGS. 8A-8C. The core structure 274 is stamped from a refractory metal material in a fan-like arrangement to provide multiple tapered legs 276 that are joined with a connecting portion 278. The legs 276 are twisted from their initial position relative to the connecting portion 278, as shown in FIG. 8B. Ends of legs 256 are cupped to provide an arcuate cross-sectional shape.

Cupping allows the designer to tailor the $h*A*(\Delta T)$ term to either side of the airfoil by changing the amount of coolant passage area that is in near proximity to the external surface 58. FIG. 7 depicts the cooling passage 56 oriented with it thickness parallel to the exterior surface 58 on the convex side. Therefore, there is roughly 50% rib and 50% cooling passage perpendicular to the exterior surface 58. On the opposite exterior surface the angled cooling passage brings much more of the passage surface area in close proximity to that exterior surface.

After the legs 276 have been twisted, the legs 276 are deformed and pushed toward one another at a location opposite the connecting portion 278 to provide the desired core shape, which is shown in FIG. 8C.

Although example embodiments have been disclosed, a worker of ordinary skill in this art would recognize that certain modifications would come within the scope of the claims. For that reason, the following claims should be studied to determine their true scope and content.

What is claimed is:

1. A turbine engine airfoil comprising:

an airfoil structure including a side having an exterior surface, the structure having a cooling passage with a cross-sectional area provided by a width and a thickness, the width greater than the thickness, the cooling passage extending a length within the structure and providing a convection surface facing the side, the convection surface twisted along the length varying a heat transfer rate between the exterior surface and the convection surface along the length, wherein the convection surface twists less than one complete turn along the length.

2. The turbine engine airfoil according to claim 1, comprising a platform from which the airfoil structure extends, and a root extending from the platform opposite the airfoil structure.

3. The turbine engine airfoil according to claim 2, wherein the cooling passage extends in a direction from the platform to a tip of the airfoil structure.

4. The turbine engine airfoil according to claim 2, comprising a cooling channel extending along the length within the structure, the cooling passage arranged between the cooling channel and the exterior surface.

5. The turbine engine airfoil according to claim 1, wherein the cooling passage includes a generally uniform cross-sectional area along the length.

6. The turbine engine airfoil according to claim 5, wherein the cross-sectional area is generally rectangular in shape.

7. The turbine engine airfoil according to claim 1, wherein the cooling passage includes an arcuate cross-sectional shape.

8. The turbine engine airfoil according to claim 1, comprising a wall between the exterior surface and the convection surface, the wall having a greater volume away from a tip of the airfoil structure than in closer proximity to the tip.

9. The turbine engine airfoil according to claim 8, wherein the cooling passage includes a cross-sectional area perpendicular to a radial direction of the airfoil structure, the convection surface of the cross-sectional area including a first portion at a first distance from the exterior surface and a second portion at a second distance from the exterior surface, the second distance greater than the first distance.

10. The turbine engine airfoil according to claim 1, comprising multiple cooling passages interconnected by a connecting portion.

11. A turbine engine airfoil comprising:

an airfoil structure including a side having an exterior surface, the structure having a cooling passage with a cross-sectional area provided by a width and a thickness, the width greater than the thickness, the cooling passage extending a length within the structure and providing a convection surface facing the side, the cooling passage separated from the exterior surface by a wall, the convection surface having a generally uniform width, the convection surface at a first distance from the exterior surface at a first location along the length and at a second distance greater than the first distance at a second location along the length, wherein the convection surface twists less than one complete turn along the length.

12. The turbine engine airfoil according to claim 11, wherein the side is a suction side of the airfoil.

13. The turbine engine airfoil according to claim 11, wherein the cooling passage extends radially along the airfoil structure from a platform toward a tip.

* * * * *